US007350460B2

(12) United States Patent
Davidson

(10) Patent No.: US 7,350,460 B2
(45) Date of Patent: Apr. 1, 2008

(54) GOLF BAG HAVING IMAGE THEREON, SYSTEMS AND METHODS OF FORMING SAME, AND METHODS OF USING GOLF BAG

(75) Inventor: Bruce A. Davidson, Sugar Land, TX (US)

(73) Assignee: Picbags, L.P., Houston, TX (US)

( * ) Notice: Subject to any disclaimer, the term of this patent is extended or adjusted under 35 U.S.C. 154(b) by 0 days.

(21) Appl. No.: 11/603,369

(22) Filed: Nov. 22, 2006

(65) Prior Publication Data

US 2007/0062384 A1 Mar. 22, 2007

Related U.S. Application Data

(62) Division of application No. 10/755,899, filed on Jan. 13, 2004, now Pat. No. 7,152,524.

(60) Provisional application No. 60/439,870, filed on Jan. 14, 2003.

(51) Int. Cl.
*B41F 17/00* (2006.01)

(52) U.S. Cl. ..... 101/35; 206/315.3

(58) Field of Classification Search ..... None
See application file for complete search history.

(56) References Cited

U.S. PATENT DOCUMENTS

| | | | |
|---|---|---|---|
| D65,222 | S | 7/1924 | Cady |
| D65,250 | S | 7/1924 | Connor |
| D82,149 | S | 9/1930 | Gomi |
| D154,374 | S | 7/1949 | Feigl |
| D177,812 | S | 5/1956 | Hyman |
| 3,867,971 | A | 2/1975 | Hazan |
| 4,528,233 | A | 7/1985 | Free |
| 4,911,073 | A | 3/1990 | Sillars |

(Continued)

FOREIGN PATENT DOCUMENTS

WO WO92/03292 A1 3/1992

OTHER PUBLICATIONS www.trendytotes.com; "date unknown".

(Continued)

*Primary Examiner*—Daniel J. Colilla
*Assistant Examiner*—Marissa Ferguson-Samreth
(74) *Attorney, Agent, or Firm*—Bracewell & Giuliani LLP

(57) ABSTRACT

A golf bag system, a golf bag having an image positioned thereon, and methods of forming and using the golf bag are provided. The system preferably includes a golf bag having a main bag body including an open end, a closed end, a club chamber positioned between the open and closed ends, an outer surface portion, and an image thereon positioned on the outer surface portion. The system can also include a memory having an image stored thereon, a controller to obtain the image and control printing, and a printing device. A method of forming images on a golf bag can include obtaining an image to be formed onto the golf bag and forming the image onto the golf bag. A method of using a golf bag having images thereon can include examining the golf bag, physically comparing an image on the golf bag with a known image associated with the alleged golf bag owner, determining ownership, and issuing the golf bag to the determined owner.

8 Claims, 12 Drawing Sheets

U.S. PATENT DOCUMENTS

| | | | |
|---|---|---|---|
| D310,156 | S | 8/1990 | Chen |
| D326,590 | S | 6/1992 | Ruby |
| 5,176,253 | A | 1/1993 | Perrin et al. |
| 5,255,834 | A | 10/1993 | Bendersky |
| D374,348 | S | 10/1996 | Sarver |
| 5,560,479 | A | 10/1996 | Leyba et al. |
| 5,632,496 | A | 5/1997 | Nelson |
| 5,718,336 | A | 2/1998 | Haarlander |
| 5,795,283 | A | 8/1998 | Romer |
| 5,881,384 | A | 3/1999 | Williams |
| 5,891,019 | A | 4/1999 | Young et al. |
| 6,017,035 | A | 1/2000 | Glasser et al. |
| D423,216 | S | 4/2000 | Medeiros |
| 6,109,529 | A | 8/2000 | Nelson, Jr. |
| 6,154,992 | A | 12/2000 | Lee |
| 6,213,304 | B1 | 4/2001 | Juliussen |
| 6,220,432 | B1 | 4/2001 | Tan |
| 6,267,243 | B1 | 7/2001 | Sumpmann et al. |
| 6,344,853 | B1 | 2/2002 | Knight |
| 6,414,693 | B1 | 7/2002 | Berger et al. |
| 6,439,370 | B1 | 8/2002 | Hoffman, Jr. et al. |
| D467,138 | S | 12/2002 | Stanphill |
| 6,505,858 | B1 | 1/2003 | Kirchmeyer et al. |
| 6,793,688 | B2 | 9/2004 | Tyler et al. |
| 2002/0062264 | A1 | 5/2002 | Knight |
| 2004/0026280 | A1 | 2/2004 | Herold |

OTHER PUBLICATIONS

Golfweek Magazine, Aug. 31, 2002, advertisement of Golf Logos at p. 36; photo depicting golf bag and logo at p. 18; also shown at www.golfweek.com.

www.contessabags.com; Aug. 2003.

www.anyahindmarch.com; “date unknown”.

www.laurabeedesigns.com; Sep. 2002.

www.imagestation.com; “date unknown”.

www.ysmny.com; Jan. 2002.

GOLF BAG HAVING IMAGE THEREON, SYSTEMS AND METHODS OF FORMING SAME, AND METHODS OF USING GOLF BAG

RELATED APPLICATIONS

This application is a divisional of U.S. application Ser. No. 10/755,899, filed Jan. 13, 2004, now U.S. Pat. No. 7,152,524 which claims priority to U.S. provisional application Ser. No. 60/439,870 filed on Jan. 14, 2003 and is incorporated herein by reference in its entirety.

BACKGROUND OF THE INVENTION

1. Field of the Invention

The present invention relates to the field of golf and, more specifically, to formation and use of golf bags. Additionally, the present invention relates to golf bags having photographic-type images thereon.

2. Brief Description of Related Art

The game of golf has been growing in popularity each year. As is commonly known a golf bag is typically used to transport a set of golf clubs, golf balls and other golfing accessories throughout a golf course. Conventional golf bags, although possibly varying in color or in the type of external surface, typically are physically and structurally quite similar, i.e., having an elongated, tubular chamber having one end closed and the other open for placement of the golf clubs therein. As the sport of golf becomes ever more popular, different styles of golf bags, memorabilia related to golf, golf related souvenirs, and various other golf related items are needed and desired. Also, it can often become difficult for a golfer to identify his or her golfing bag or for the golf club clubhouse personnel or caddie to identify the proper golf bag.

In an attempt to quickly distinguish his or her golf bag from another, golfers have begun to attach tags, stickers, and other identification items onto the carrying strap, a zipper, or around the golf bag itself. It has also been known to attach golf course tags, towels, or stickers to golf bags as memorabilia of a golf course or a golfing experience. The present inventor, however, has recognized that other types of memorabilia are still needed and that these temporary fixes to identification of golf bags have proven to be unreliable. Much like a baggage luggage tag provided at an airport, over a very short period of time and after being exposed to the elements, these items have the tendency to either separate or be torn from the golf bag. Additionally, these baggage tags and stickers often are not aesthetically pleasing.

As the above methodology and devices have proved to be unsuccessful, many golfers and manufacturers have alternatively tried sewing or embroidering indicia such as monograms, symbols, and patches onto the bags. For example, U.S. Pat. No. 5,632,496, by Nelson, titled "Convertible Golf Bag System," describes a golf bag having a side panel capable of being embroidered with personalized insignia. The present inventor has recognized that sewing and embroidering indicia onto conventional golf bags can be very difficult and labor intensive because it has been typically achieved by hand and without the use of sewing machines, and has proven to be less stylish than desired. Even the advent of golf bags with single-walled removable golf panels has not been successful in solving these problems. For example, U.S. Pat. No. 5,560,479, by Leyba et al., titled "Golf Bag with Removable Panels and Method for Affixing Indicia Thereto," describes a golf bag having indicia sewn on a removable side panel. Some attempts have been made to develop golf bags with removable pockets or panels in order to allow the panel to be taken to a sewing shop and have the insignia sewn-on with a machine. For example, U.S. Pat. No. 6,220,432, by Tan, titled "Detachable Golf Bag Logo Panel Mounting Structure," describes a golf bag having a removable logo panel, and U.S. Pat. No. 5,176,253, by Perrin et al., titled "Golf Bag with Pocket Assembly," describes a golf bag having a fixedly attached zippered pocket. The present inventor, however, has recognized that the detachability has proven to be detrimental to the purpose of the pocket or pouch. The detachable panel can be easily lost and can have a tendency to not provide sufficient security for the item stored within the panel or provide the durability provided by non-detachable panels and pockets.

It has also become increasingly stylish to display a decal from a famous golf course visited and/or conquered by a golfer, a golf facility insignia which sold or provided the bag, or other distinctive ornamentation. This type of insignia has somewhat aided the individual golfer in identifying ownership of his golf bag when his golf bag is situated among other golf bags. The present inventor, however, has recognized that the use of the previously described embroidery or this new type of golf course decal or insignia, alone, has not proven to be successful when used by a clubhouse. Though an individual golfer may recognize a golf bag from the insignia, the clubhouse storing or issuing a golf bag to a golfer often is not provided sufficient identification to determine proper ownership.

Use of barcodes has been attempted to try to facilitate the flow of golfers through a golf bag-handling area and to reduce the amount of handling of the bags necessary to match the golf bag recipient with the appropriate bag. For example, a bar code, such as the one described in U.S. Pat. No. 6,109,529, by Nelson, Jr., titled "Bar Code Identification and Record Assembly," would allow rapid entry into a computer of nearly error-free golf bag/golf bag recipient data. Although marginally successful in tracking the destination of the bag initially issued from the clubhouse, the present inventor has further recognized that the use of bar codes has nevertheless proved wholly inadequate where a large number of golfers have placed the golf bag for temporary storage and retrieval. The use of barcodes also can be complex, awkward and expensive and can require use of a scanner which must be passed over the barcode. This clearly does not lead to a quick visual identification.

Accordingly, it can be appreciated that there still exists a need for a golf bag having a durable image which is aesthetically pleasing, provides memorabilia for a golfer, and promotes golf bag identification. There is also a need for a system and methods of forming and using golf bags with various images on the bag.

SUMMARY OF THE INVENTION

In view of the foregoing, embodiments of the present invention advantageously provide a golf bag having an image that does not require sewing or embroidering and that is uniquely recognizable. Advantageously, embodiments of the present invention also provide a golf bag that is esthetically pleasing and that includes memorabilia for a golfer of a golf course, golf shot, golf hole, a golfing event, or other event important to the golfer. Advantageously embodiments of the present invention provide a method of using a golf bag having image thereon to determine ownership of the golf bag. Advantageously, embodiments of the present invention additionally provide a system and method for forming a golf bag having an image thereon, which is easy to use and that can use currently available technology, if desired.

More particularly, the present invention is related to a golf bag having an image formed thereon and a system and methods of forming and using golf bags with various images on the golf bag. A golf bag often has an elongate main bag body having a frame including an open end, a closed end, and a club chamber positioned between the open and closed ends to provide access to golf clubs when inserted into the open end. The main body includes a fabric covering positioned on the frame having a substantially flat side outer surface portion positioned between the open end and a closed end and an arcuate outer surface portion adjacent the substantially flat side outer surface portion. A pocket or other fabric panel or space can be located at this side portion or elsewhere on the outer surface. An image, preferably digital or other photographic-type, can be formed onto the outer surface of the golf bag, e.g., directly on the exterior fabric or outer surface of the golf bag such as on the pocket or fabric panel or space. The digital or other photographic-type image, as applied in the various embodiments of the present invention, has numerous applications and uses. For example, the digital or other photographic-type image can advantageously be a scenic golf hole from a golf course or a memorable golf shot or hole played, for use to assist in readily identifying the owner such as during tournament play, special events, or even just to store and locate the golf bag in the owner's locker at a club. Also, the image can be a photograph of the owner of the golf bag, a photograph of a hotel or resort, an automobile photograph, a photograph of a family member, a photograph or image of popular or famous sports figure, a TV, movie, or music star, or other images and photographs as creatively desired.

The present invention is also related to a combination of a system and a golf bag, and methods of forming and using the images positioned on a golf bag. The system includes a golf bag having an elongate main bag body having a frame including an open end, a closed end, and a club chamber positioned between the open and closed ends into which golf clubs can be inserted, and a fabric covering. The fabric covering includes an outer surface portion and an image on the outer surface portion positioned to be readily visible to a user thereof. The system also can include a memory having the image stored thereon, a controller to obtain the image from the memory and to control printing of the image, and a golfbag image printer positioned to print the image onto the outer surface portion of the fabric covering of the golf bag.

The method of forming images on the golf bag can include either obtaining, or creating, an image to be formed onto the outer surface, and forming the image onto an outer surface portion whereby the image is readily visible and not readily removable. The step of obtaining, or creating, an image to be formed onto the outer surface can include obtaining digital or other images from a database, a website of a global communications network, photography equipment having photographs stored thereon, or other storage devices or databases of images. The step of forming the image onto the outer surface portion includes one or more of the following methodologies, including forming or printing the image directly onto the exterior fabric of the golf bag, as a laminate insert into a pocket of the golf bag, or forming the image as an insert into a laminate region of the golf bag.

The method of using a golf bag having images thereon can include examining a golf bag having an image positioned on an outer surface of the golf bag, physically comparing an image positioned on the outer surface of the golf bag with the physical appearance of an alleged golf bag owner, determining ownership based on the physical comparison, and issuing the golf bag to the proper owner with no further identification required.

The method of using a golf bag having images thereon can also include identifying the owner of the golf bag by physically comparing a photographic-type image positioned on the outer surface of the golf bag with either a description of the image provided by the owner, or where the image is in the form of the owner of the golf bag, by comparing the photographic-type image with a physical appearance of the owner of the golf bag. In either case, once identification is made, the golf bag can be issued to the owner including the owner's representative, with no further identification required.

The method of using a golf bag having an image in the form of a photographic-type image of a physical appearance of a golfer thereon, can include presenting the golf bag to a golfing facility employee at a golfing facility as a substitute for an identification card.

BRIEF DESCRIPTION OF THE DRAWINGS

Some of the features, advantages, and benefits of the present inventions, having been stated, others will become apparent as the description proceeds when taken in conjunction with the accompanying drawings in which.

DETAILED DESCRIPTION

Figure 1:
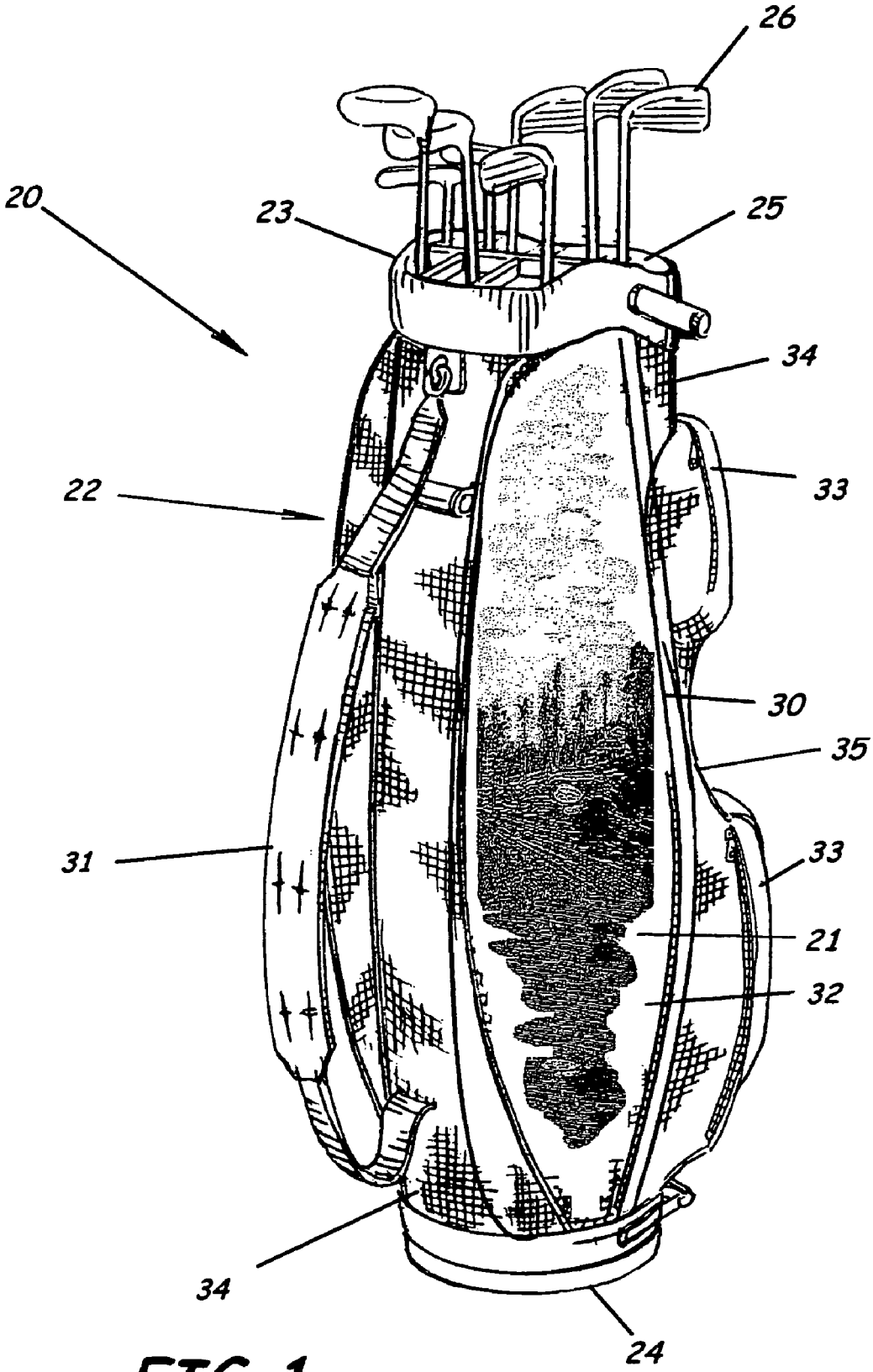
FIG. 1 is a perspective view of a golf bag having an image thereon according to an embodiment of the present invention.

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments. Note, the term photographic-type image includes but is not limited to actual photographs, prints, or other images of what an artist would consider near photograph quality such as print of a well painted scene.

As illustrated in FIGS. 1-13, embodiments of the present invention advantageously provide a golf bag 20 improved and modified to include an image 21 thereon and associated system and methods for forming and using the images 21. More particularly, as perhaps best shown in FIG. 1, a golf bag 20 typically has an elongate main bag body 22 having a frame and including an open end 23 and a closed end 24, and a club chamber 25, positioned between the open and closed ends 23, 24, to thereby form an accessible storage and transportation compartment and to provide access to golf clubs 26 when inserted into the open end 23 of the golf bag 20. The main body 22 also includes a substantially permanently affixed fabric covering or other material positioned on the frame. The fabric or other material covering surrounding the frame of the golf bag 20 further forms the outer surface 35 of the golf bag 20 and has a substantially flat side outer surface portion 30. A pocket or other fabric panel 32 of the covering can be located at this side portion 30, if desired. This pocket or other fabric panel 32 can be also substantially permanently affixed to the outer surface 35 of golf bag 20. An image 21 can be positioned on the pocket or other fabric panel 32 of a substantially flat side outer surface portion 30, on an arcuate portion 34 adjacent the substantially flat side outer portion 30, or elsewhere on the exterior surface 35 of the golf bag 20, but is preferably positioned such that it is readily visible and not readily removable.

The golf bag 20 further includes a front handle or carrying strap 31 and optionally a side carrying strap (not shown), connected to an outer surface 35 of the fabric covering the golf bag 20 for carrying the golf bag 20. Functionally, golf clubs 26 are stored and transported using a golf bag 20 by loading the golf clubs 26 through the open end 23 of the club chamber 25. The golfer can carry the golf bag 20 by either inserting a shoulder between the front carrying strap 31 and the outer surface 35 or by grasping one of the carrying straps to carry the golf bag 20 in suitcase fashion.

As illustrated, the outer surface 35 of the golf bag 20 can include a plurality of pockets and other fabric panels or spaces 32, 33, primarily designed to hold golfing accessories and equipment. For example, a golf bag 20, according to an embodiment of the present invention, can include a large pocket 32 inserted on the rear of the outer surface 35, and typically used for storing larger golf club accessories, such as covers or cleaning towels, and generally at least one or more other smaller pockets 33 used to store golfing accessories such as golf balls or golf tees. With few exceptions, neither of the pockets or panels 32, 33, are generally manufactured to be detached, as they would likely be lost, would inadvertently open, or would otherwise fail to properly serve their carrying and storing function. The non-removability of the panels or pockets 32, 33 having an image 21 formed thereon, according to an embodiment of the present invention, is a significant advantage because the state-of-the-art has not yet conceived of such printing of such image type (described below) on such substantially permanently affixed panels or pockets 32, 33.

An embodiment of the present invention, such as that illustrated in FIG. 1, takes both conventional and custom golf bags 20 and enhances their functionality by forming or permanently affixing an image 21 such as a photographic-type image onto an outer surface 35 thereof such as a substantially flat side outer surface portion 30 of the golf bag 20. The location of the image 21 is preferably selected such that the image 21 can be readily visible to a user thereof when placed among a plurality of golf bags 20 on a multi-golf bag facility stand such as that typically associated with a golf facility. The image 21 according to an embodiment of the present invention can include any number of various types of images imaginable. For example, the photographic-type image 21 may be a digital or other photographic-type image of a scenic golf hole from a golf course, a memorable golf shot or hole played, or a hotel or resort. The image 21 can also include less fanciful images such as the manufacturer, manufacturing facility or affiliation, an automobile photograph, a photograph of a family member, a photograph or image of popular or famous sports figure, TV, movie, or music star, or other images and photographs as creatively desired.

Figure 2:
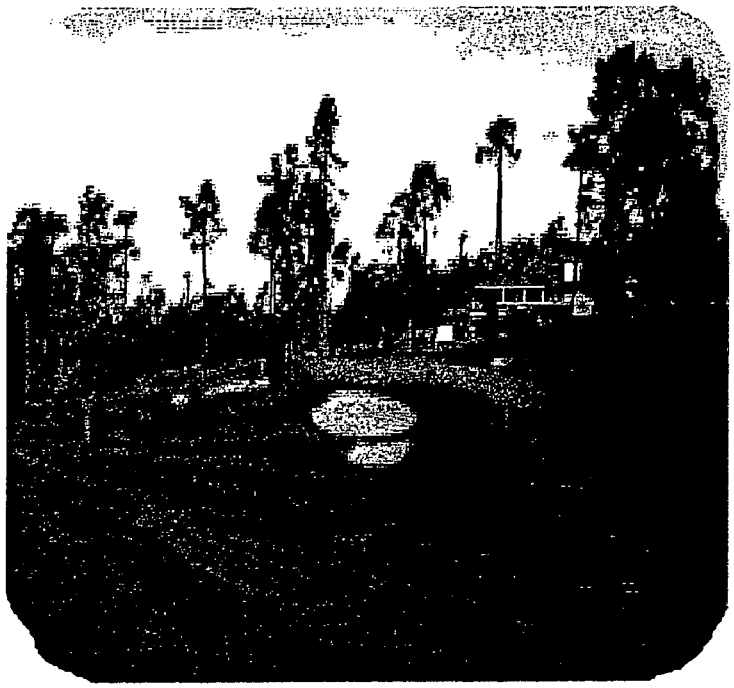
FIG. 2 is an environmental view of a championship golf course.

The image 21 can be used as a form of status symbol or memorabilia. For illustrative purposes only, consider Poppy Hills golf course (FIG. 2). Poppy Hills is a championship golf course which has replaced Cypress Point in the rotation of courses used in the AT&T Pro-Am. Conquering a difficult course such as this results in a two-fold event. First, the individual golfer extracts a relative amount of prestige, especially among other less successful brethren, merely from playing such a high-caliber course. And second, the event may be so memorable that the individual may wish to dwell upon for years to come.

Figure 3:
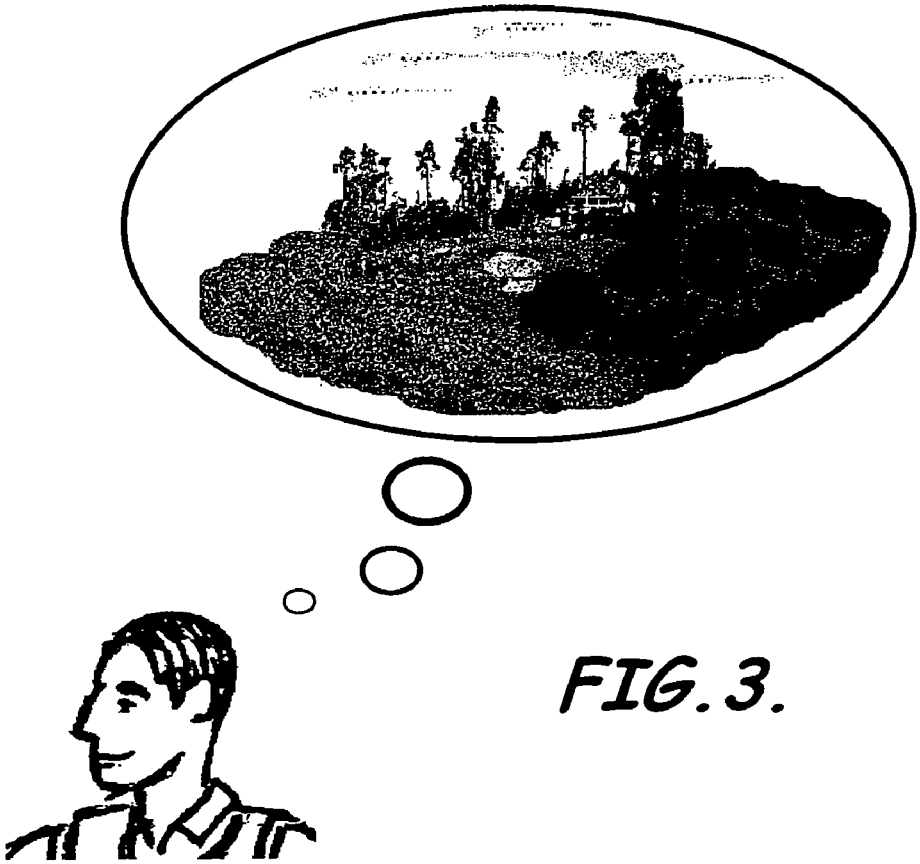
FIG. 3 is an illustrative view of the mental effect created by an embodiment of the present invention.
Figure 4:
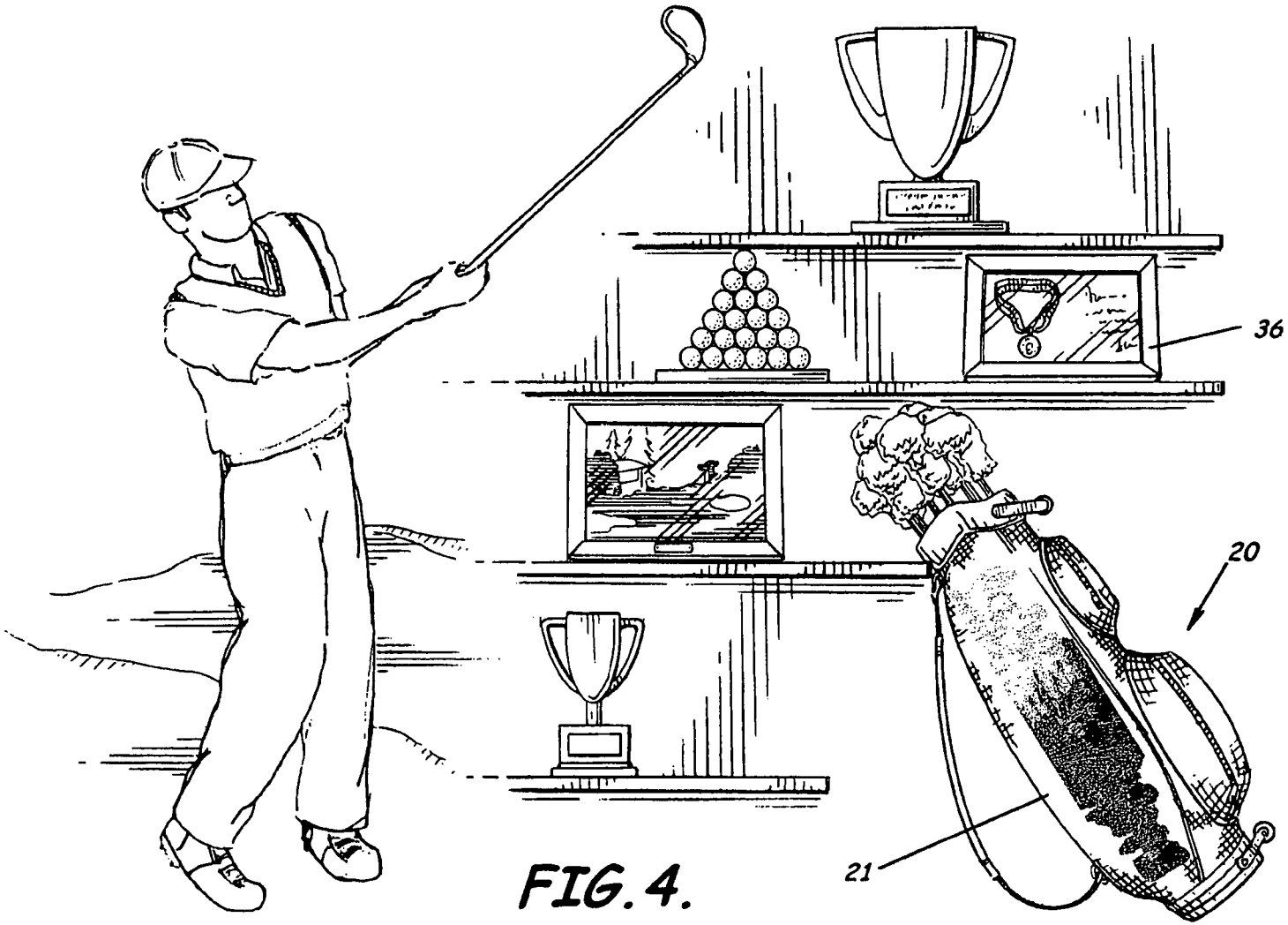
FIG. 4 is a split image of an environmental view of a championship golf course and an illustrative view of an application of an embodiment of the present invention.

As shown in FIGS. 2, 3 and 4, the image 21 can be an image of such a famous golf course or golfing event. This image 21 provides the individual golfer's memory an impetus to spark recollection of the event which in turn causes a synergistic effect between the event and the purchase or modification of a golf bag 20, according to the present invention. This synergism tends to add not only emotional but commercial value to both the golfing event and the golf bag 20 having image 21. Additionally, as a bonus, prestige value may be added as the golf bag 20 having photographic-type image 21 may be a conversation piece among the golfer's peers, provided the photographic-type image 21 selected has such basis for delivering such prestige.

In another embodiment of the present invention, as a methodology of maintaining prestige among a select class of golf related images or corresponding events, in order to obtain such image, the individual golfer must be issued a certificate 36 (FIG. 4) from a famous championship golf course signifying a particular standard of completion, such as either 9 or 18 holes completed, or a hole-in-one, birdie, or eagle accomplished on an exceptionally difficult hole of a select championship level course. In a related embodiment of the present invention, the image manufacturer provides the service of approving the release of the image 21. Thus, an embodiment of the present invention can satisfy a current desire to develop a golfer's personal golf bag 20 into a form of memorabilia, enhance the value of the golf bag 20 through a prestige factor, and provides the golfer a status symbol analogous to the flags painted on conquering vessels such as fighter aircraft signifying the shoot-down of an enemy aircraft.

Figure 5:
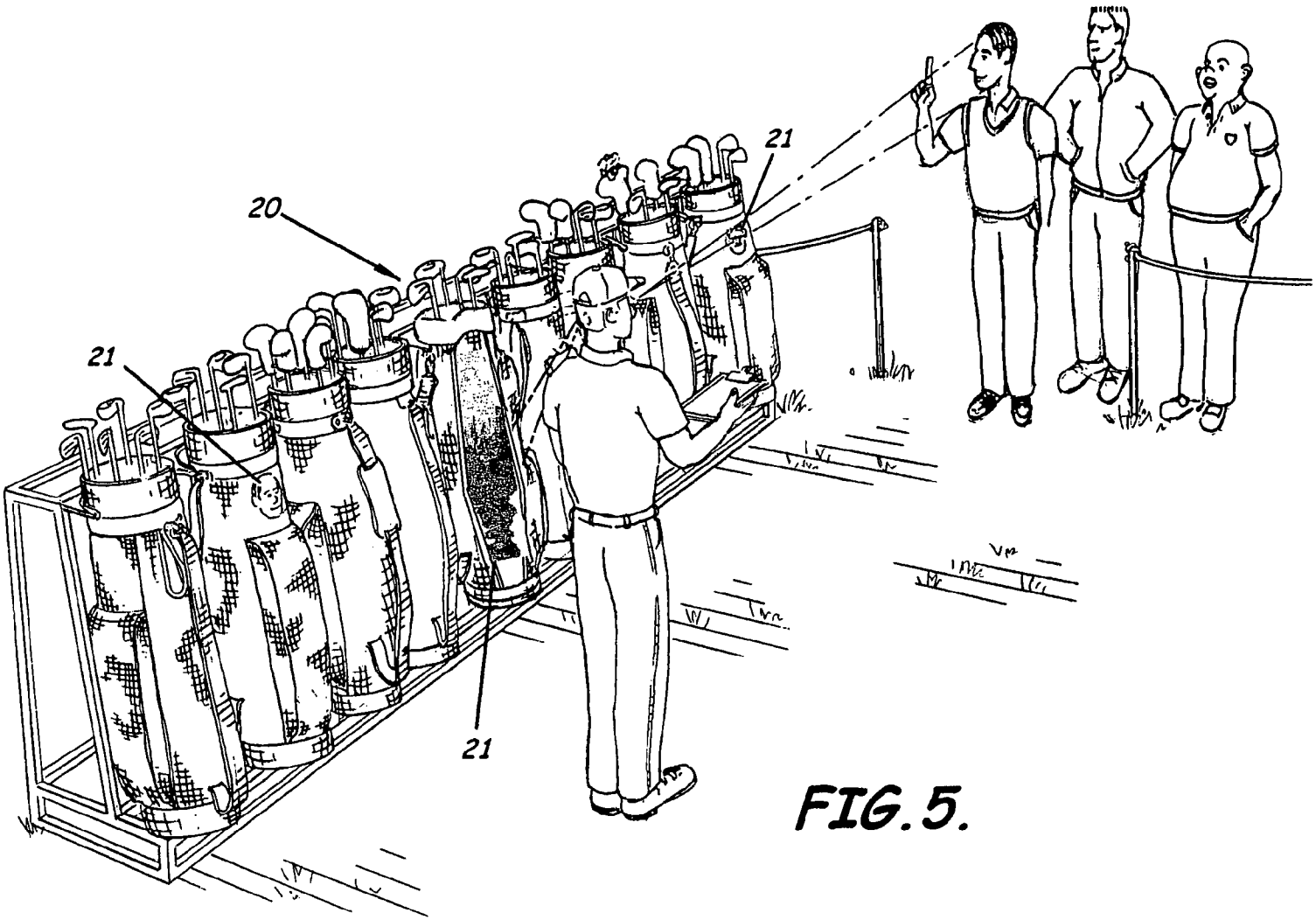
FIG. 5 is an environmental view of a golf bag having an image thereon, according to an embodiment of the present invention, and depicting an embodiment of a method of use of the embodiment of present invention.

As shown in FIG. 5, if the image 21 is even marginally unique in any shape or form, the image 21 can be readily used to assist the owner in readily identifying the golf bag 20, i.e., the image 21 can function to allow the golfer, caddie, or golf bag owner to easily and quickly identify the golf bag 20 among a group of others through visual recognition of the image 21. This is especially important when time is critical, as in the case of a tournament, where the owner's golf bag 20 is placed among golf bags of other owners.

Although an individual golfer, caddie, or owner may recognize a golf bag 20 from just that unique image 21, unless the clubhouse holding or issuing of a golf bag 20 to a golfer is also the owner of the golf bag 20, the clubhouse may not be provided sufficient identification to determine proper ownership without a more objective identifying feature. Therefore, in an embodiment of the present invention, at least one image 21 is a photograph or other physical representation of the owner of the golf bag 20, for use to assist in readily identifying the owner, i.e., the image can be used as an identification card.

As stated above, the image 21 is preferably readily visible and preferably not readily removable, i.e., substantially permanently affixed in order to prevent inadvertent removal or destruction. The image 21 further is preferably of a quality equivalent to that of at least 10,000 dots per square inch, and even more preferably at least 90,000 dots per square inch, depending on the printing methods selected, discussed below. In this way, as shown in FIG. 5, anyone unfamiliar with the owner or his golf bag 20 can use the image 21 to more easily assist in readily identifying the owner. For example, the golfer may ask a clubhouse employee not generally familiar with the golfer for the golfer's bag 20, to retrieve the bag 20 from the locker area. The employee, with little effort, merely needs to look for the image 21 of the golfer in order to retrieve the proper bag and convey it to the proper owner without the need for additional identification. Correspondingly, an image 21 of such quality and in the form of the golf bag owner can be used as a substitute for an identification card. Thus, an embodiment of the present invention also satisfies a current need for improving efficiency of the clubhouse.

An embodiment of the present invention also advantageously includes a system and methods of forming an image thereon, and using images in order to identify the proper owner of the golf bag 20. The system, as best summarized in FIGS. 1, and 6-10, preferably includes a golf bag 20 having an elongate main bag body 22 having a frame and including an open end 23 and a closed end 24, and a club chamber 25, positioned between the open and closed ends 23, 24, to thereby form an accessible storage and transportation compartment and to provide access to golf clubs 26 when inserted into the open end 23 of the golf bag 20. The main body 22 also includes a substantially permanently affixed fabric covering or other material positioned on the frame. The fabric or other material covering surrounding the frame of the golf bag 20 further forms the outer surface 35 of the golf bag 20 and has a substantially flat side outer surface portion 30. A pocket or other fabric panel 32 of the covering can be located at this side portion 30, if desired. This pocket or other fabric panel 32 is also substantially permanently affixed to the outer surface 35 of golf bag 20. An image 21 can be positioned on the pocket or other fabric panel 32 of the substantially flat side outer surface portion 30 or elsewhere on the outer surface 35 but is preferably positioned to be readily visible and preferably not readily removable, i.e., substantially permanently affixed.

Figure 6:
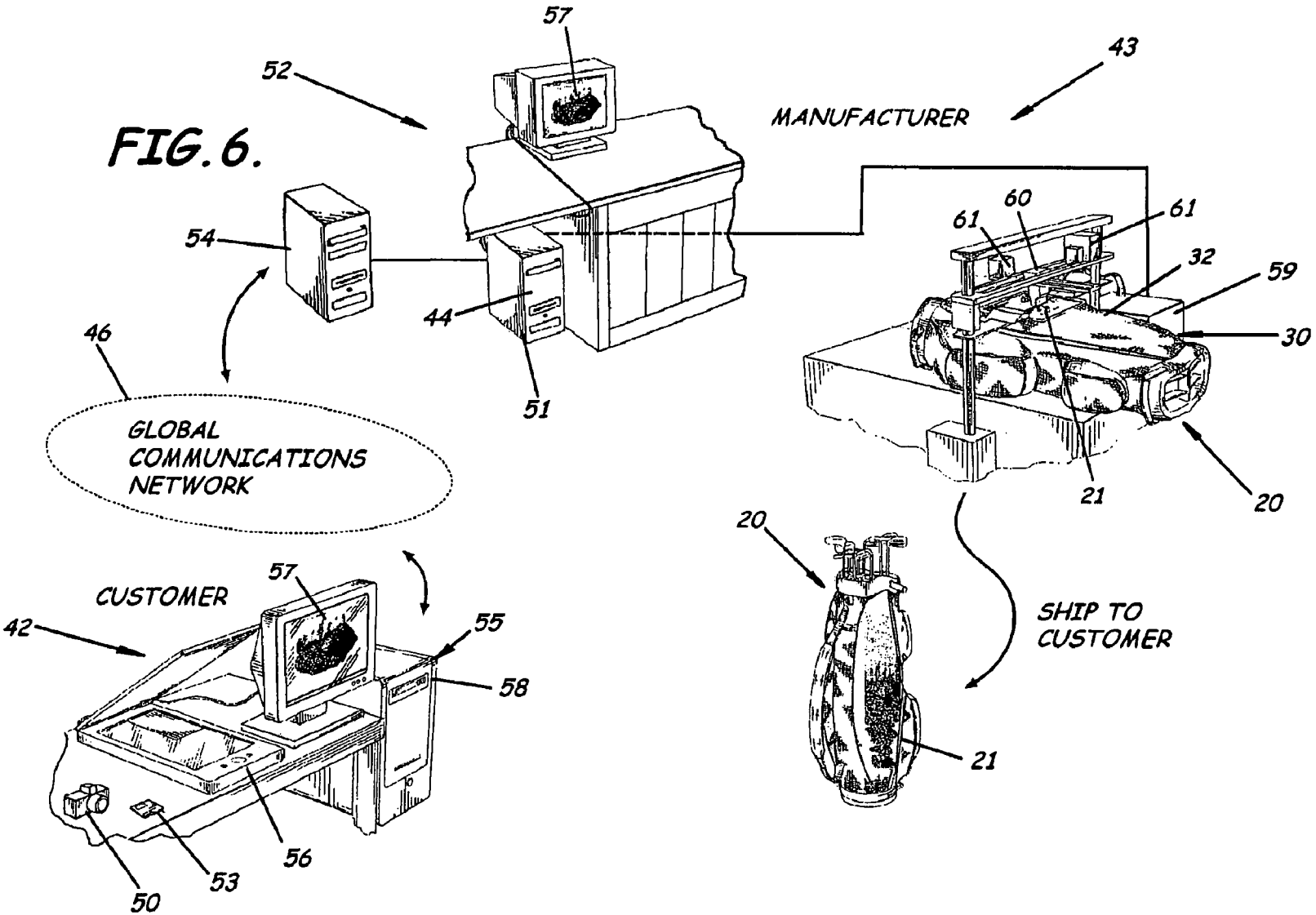
FIG. 6 is a schematic diagram of a system to form images on a golf bag, according to an embodiment of the present invention.
Figure 7:
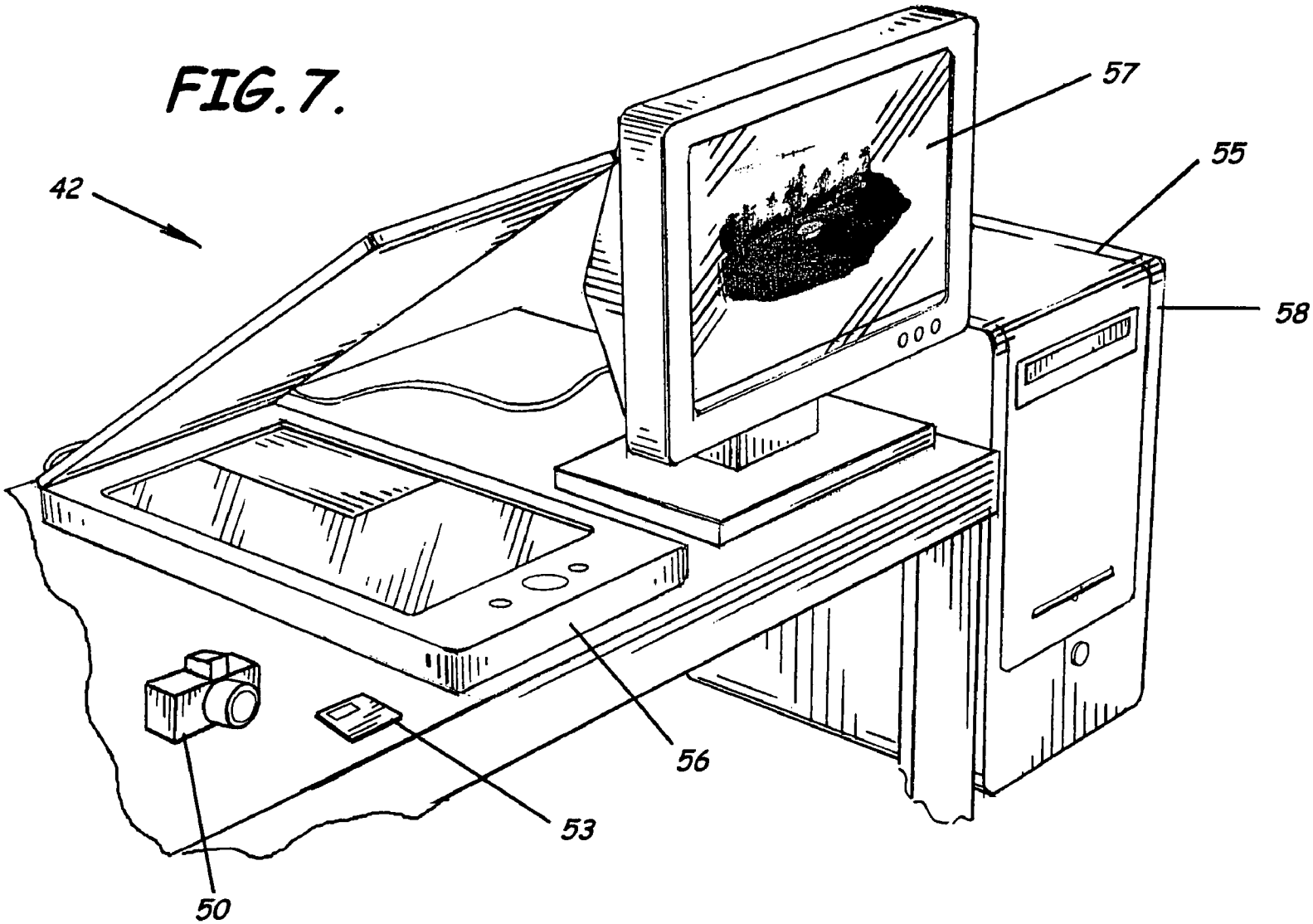
FIG. 7 is a perspective view of a portion of a system to form images on a golf bag, according to an embodiment of the present invention.
Figure 10:
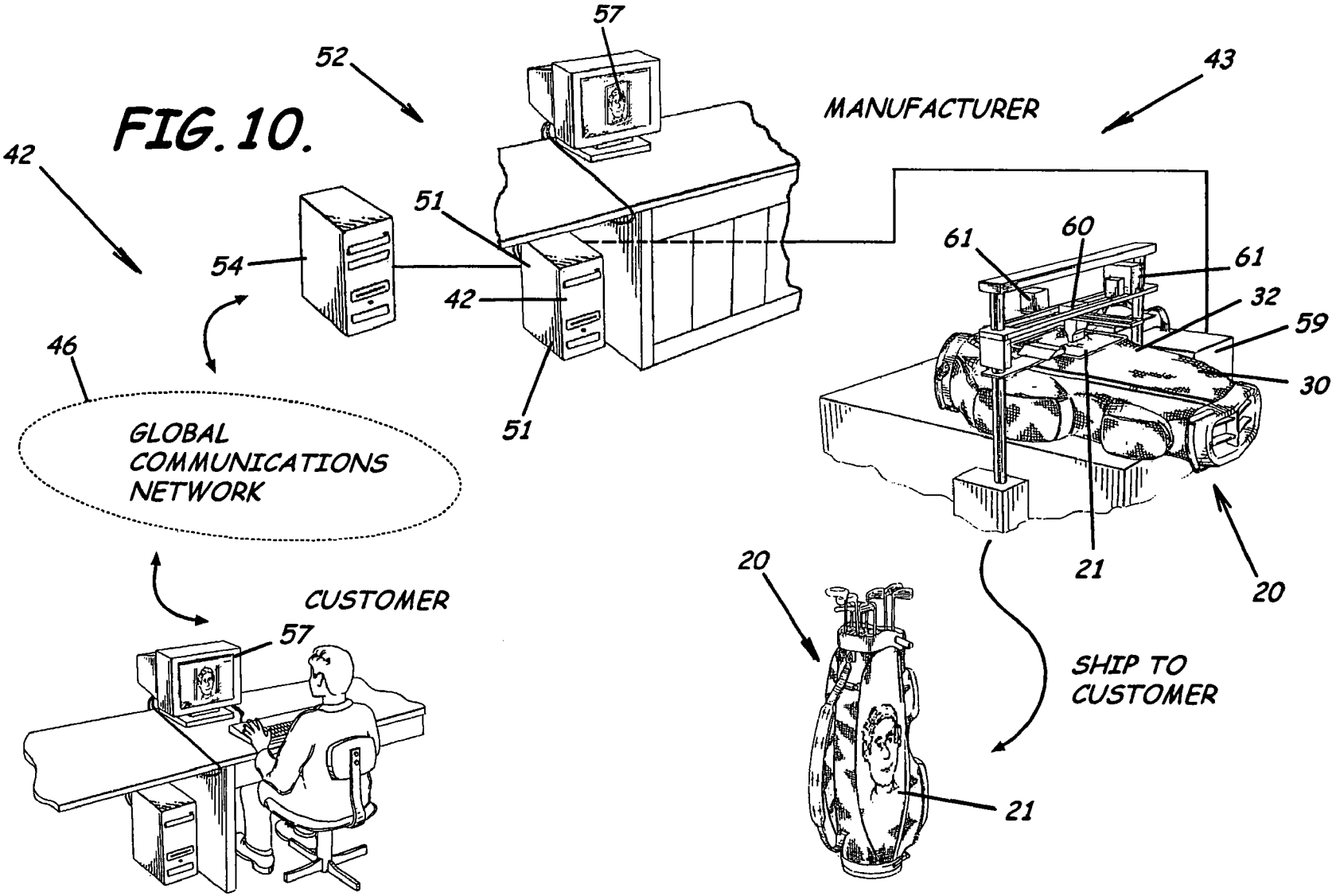
FIG. 10 is a schematic diagram of a system to form images on a golf bag, according to another embodiment of the present invention

The image 21 can be applied directly onto the exterior fabric of outer surface 35 of the golf bag 20, as a laminate insert into a pocket 32, 33, of the outer surface 35 of the golf bag 20, or as an insert into a laminate region of the outer surface 35 of the golf bag 20. The image 21 can include a digital or other photographic-type image of a famous golf course or hole, or a memorable or prestigious golf shot or like event. The image 21 can alternatively include a digital or other photographic-type image of a golf bag owner. The system can also include means 42 for obtaining or creating the image and means 43 for forming the image 21 on the golf bag 20, as best shown in FIGS. 6 and 10, and as best described in FIGS. 11, 12, and 13.

The means 42 for obtaining, or creating, the image includes various methodologies of extracting and storing an embodiment of the image 21 for further processing and are well-known to those skilled in the art. The golf bag manufacturer can extract an existing preferably photographic-type image 57 from a memory or directly upload the physical embodiment of the image 57 into a memory. For example, the golf bag manufacture can extract the image 57 from a database such as that associated with a web site of a global communications network 46 or from the golf bag manufacturer's and/or a golf bag store's graphical images stored in their own respective database 44. Also for example, a digital camera 50 can be used to acquire the image 57. The image 57 can then either be transferred directly to a manufacturer's data acquisition medium 51, e.g., an image server, or to a database 44 accessible by the manufacturer's data acquisition medium 51, typically via a network system 52. A photographer can either transmit a removable storage medium 53 of the digital camera 50 to the manufacturer, directly download the camera 50 to the manufacturer's network interface 54, upload the images 57 from a computer 55 to a web site of the global network 46, or accomplish the task by any other equivalent method as known by those skilled in the art.

In another embodiment of the present invention, a scanner 56 can convert an embodiment of the image 21, a developed photographic print, or a negative into a image 57 scanned into a digital medium or memory 58, whereby the digitized image 57 can be easily electronically transferred. For example, a flatbed scanner or wand can be used to scan an image or a developed photographic print of the target image, a negative scanner can be used to scan photographic negative strips. As an alternative methodology, a point-of-sale machine (not shown), as understood by those skilled in the art, can be used to access an image 57 stored in the memory of a digital camera or other imaging device (scanner, personal digital assistant, hand-held computer), and perform a point-of-sale transaction for storing at least one of the images 57 at a remote site accessible to the manufacturer's data acquisition medium 51. Other alternative methodologies include non-electronic transfer to the manufacturer of an embodiment of the image 21 to be positioned on the golf bag 20. Electronic means, however, are generally preferred due to cost efficiency where the image 21 is to be a custom image or one made in the limited quantities. The non-electronic means, however, generally prove to be a suitable, cost effective method, especially where larger quantities of the same image 21 on multiple golf bags 20 are considered.

The system for forming a golf bag having images thereon, also includes means 43 for forming the image 21 on the outer surface 35 of a golf bag 20 such as the substantially flat side outer surface portion 30. Generally, when one refers to forming an image 21, one is referring to means 43 that implements a method for transferring an embodiment of the image 21 to the golf bag 20. The means 42 for obtaining, or creating the image 21, however, is not entirely independent of the selected means 43 for forming the image 21. The means 42 for obtaining, or creating, the image 21 vary depending on the means 43 selected for forming the image 21. The artisan has numerous means available to formulate the image 21 required by the present invention. The means 43 selected significantly depends on whether the image 21 will be mass-produced or printed in only a single print or small number of prints.

Regardless of the means 43 selected, the image 21 is preferably a photographic-type image substantially permanently affixed to the substrate such as the substantially flat side outer surface portion 30. The image 21 is preferably positioned to be readily visible to a user thereof when placed among a plurality of golfbags on a multi-golfbag facility stand at a golfing facility (FIG. 5).

Of the means 43 available to the artisan, halftone printing is one of the most common for color printing. In halftone printing, a multicolor image is photographed through halftone screens with color filters to reproduce the three primary colors, cyan, yellow and magenta, plus black. The halftone screens generally have a grid pattern of intersecting opaque lines impregnated on a clear substrate which leaves an array of clear dots. The screens break an image into evenly spaced dots that are larger in the dark areas of the image and smaller in the light areas. The screens vary in quality. The quality or fineness of the screens, measured in dots per inch, are directly proportional to their cost and ease of use. A very coarse screen may provide as little as 25,000 dots per square inch but be very easy to make and use, whereas finer quality screens which are harder to make and use, commonly provide image sharpness and detail in excess of 90,000 dots per square inch.

Another means 43 available to the artisan is the letterpress, known as relief printing. Relief printing uses metal type or engravings where the image areas are raised in relief above non-image areas. The ink is applied to the raised surfaces and transferred directly onto the item receiving the image, i.e., the golf bag 20. Similar or related means includes offset-printing, also known as lithography, gravure printing, and serigraphy, also known as silk-screen printing. Offset-printing uses a plate treated so that ink will adhere only to the areas that will print the design. The plate transfers its ink to a rubber cylinder which in turn offsets it onto the item receiving the image. In offset printing, color printing is achieved by photographically separating from the original picture, the four basic colors (black, magenta, yellow, and cyan), making a plate for each color, and then using the plates to print the colors successively over one another. In gravure printing, the image areas are instead recessed into the metal plate. In serigraphy, paint is applied to a fabric screen. The images formed by the paint penetrate areas not blocked by a stencil. Several stencils are used to produce a multicolored print. The process can be used for printing full-color images onto various types of objects. For comparative purposes, all these methods have the capability of printing to a resolution as high as the equivalent of 40,000 dots per square inch, or more.

Another means 43 available to the artisan is a pad printer. Pad printing, also called "imprinting," is a printing process which can be used for printing full-color images onto spherical, rounded, cylindrical and other non-flat surfaces. This method typically uses at least one flexible ink transfer pad that receives an ink image from at least one inked gravure plate. The transfer pad is placed into pressure contact with the surface of the item to receive the image. For comparative purposes, pad printing has been known to provide a quality equivalent to that of 10,000 dots per square inch, or more.

Another means 43 available to the artisan for printing full-color images is a thermal transfer printing device. Thermal transfer printing involves the transfer of an image on an object by heat and contact pressure using a device such as a thermal press. Thermal transfer printing using a thermal transfer press is essentially a two-step process. First, a transfer surface is made to hold the image. Second, the image on the transfer surface is transferred to a receiving surface, e.g., the golf bag 20. The transfer process includes transferring by holding the printed stencil in tight contact with the receiving surface while heat and pressure is applied. The heat and pressure is maintained for a sufficient time to allow completion of a sublimation process to occur which results in the image transfer. The typical thermal transfer press typically includes a heater block assembly with thermal conductive material attached to the transfer surface to heat the image. Thermal-wax-transfer printers and dye-sublimation printers provide another means of heat transfer printing. Thermal-wax-transfer printers and dye-sublimation printers, in their current form, use heat to transfer color pigment from a color ribbon. For comparative purposes, thermal transfer printing has been known to provide a quality equivalent to that of approximately 17,700 dots per square inch, or more.

Finally, but nonexclusively, there is ink-jet (bubble-jet) printing. Ink-jet printing provides non-impact means for producing images such as image 21 in response to digital signals by the deposition of ink droplets in a pixel-by-pixel manner to an image-recording substrate, such as large pocket 32, small pockets 33 or another portion of the outer surface 35 of the golf bag 20, for example. As perhaps best shown in FIG. 8, the typical ink-jet printing assembly includes a controller 59 and associated wiring, printhead 60, and stepper motors 61 to drive the printhead 60. Functionally, the controller 59 receives the image 57 from the data acquisition medium 51, activates the stepper motors 61 to position the printhead 60, and controls the flow of ink, as will be understood by those skilled in the art, to form the image 21. The ink-jet printing assembly also includes a fabric stabilizer 65 adapted to be connected to a pocket or other fabric panel 32, 33, or a portion of the exterior fabric of outer surface 35 of the golf bag 20. The fabric stabilizer 65 stabilizes the pocket or fabric panel to provide a substantially flat outer surface for printing. As perhaps best shown in FIG. 9, printhead 60' of means 43' can be positioned axially by means including stepper motors 61' across the X-axis, Y-axis, and Z-axis in relation to a substrate receiving the image 21 (e.g., an arcuate portion 34 of a golf bag 20) in order to print on such substrate.

For relatively small-scale operations, ink-jet printers typically dispense water or solvent based ink onto the substrate by heating the ink, causing it to shoot out of the nozzles. The ink dries by evaporation of the water or solvent. Some models provide additional heat to evaporate the water or solvent to dry the ink. For larger scale operations, ink-jet printing processes typically use mechanical ink propulsion techniques. Use of piezo or piezo-crystal print heads which convert electrical energy into intra-crystal vibrations that cause drops of ink to be ejected from print head nozzles, are but one means for implementing such mechanical ink propulsion.

Water or solvent based inks may be used in various types of printhead models. The type of print head selected typically depends on the level of usage. Some types of solvent based inks cure via air drying, some require external heat to enhance the evaporation process, others require heat to implement the polymerization of ink. The selection of solvent based inks is typically substrate dependent. Solvent based inks are typically matched with a particular substrate and form a chemical bond with the substrate to provide durability to the image 21. Unmatched pairs may not have an electrostatic bond and therefore typically may be easily removed by water, another solvent, or physical contact with the environment.

UV curable or other polymer based inks are preferred over water or solvent based inks where color intensity is at issue. Polymer based inks typically use piezo or piezo-crystal print heads to apply ink that dries via polymerization affected after the ink is deposited on the substrate, e.g., large pocket 32 of golf bag 20. Polymerization is accomplished by exposing a susceptible ink to some threshold level of energy. Some typical methodologies of polymerization include exposing UV curable ink to UV light after the ink is deposited on the substrate or exposing susceptible ink to a high-energy electron beam.

Figure 8:
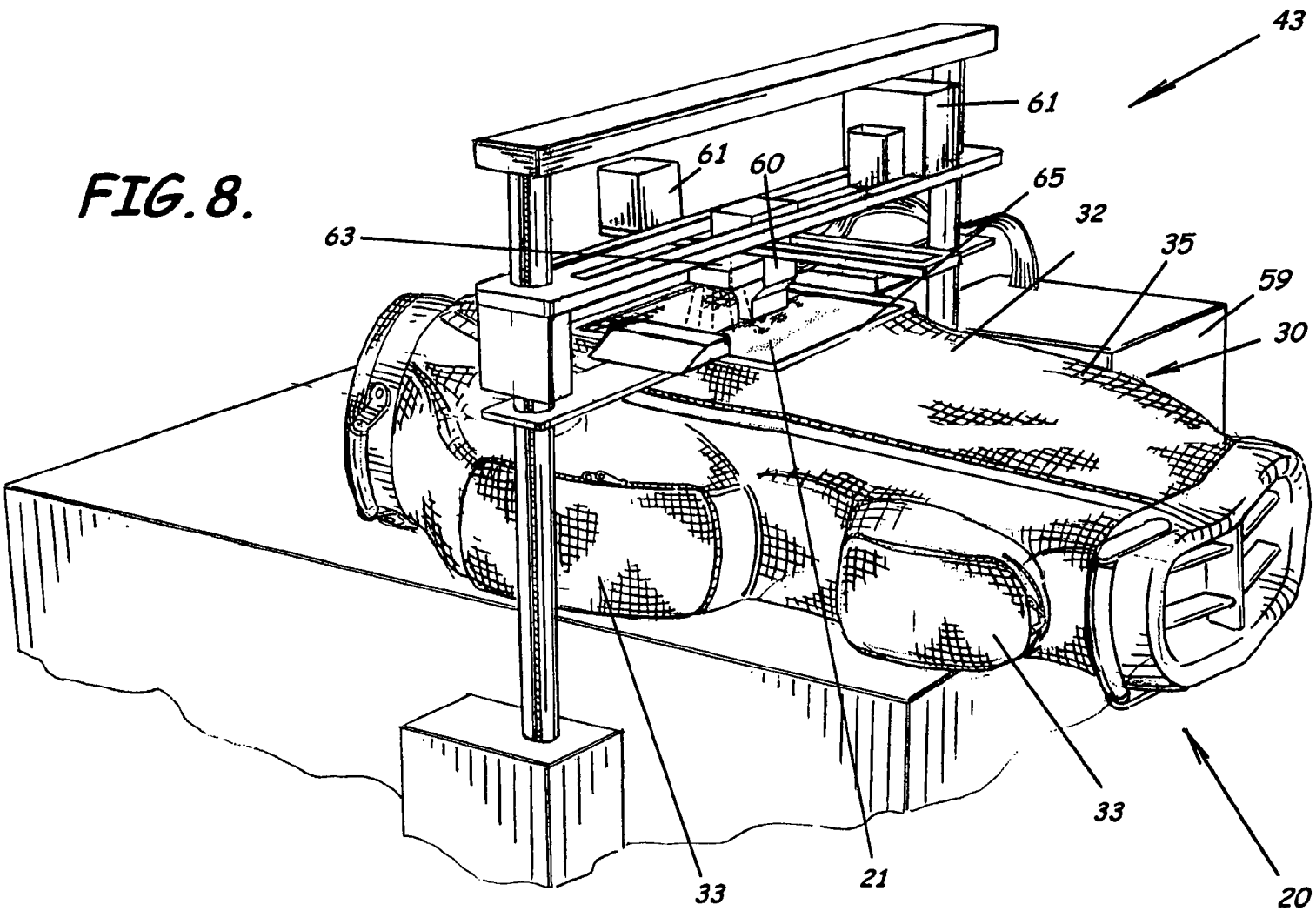
FIG. 8 is a perspective view of another portion of a system to form images on a golf bag, according to an embodiment of the present invention.
Figure 9:
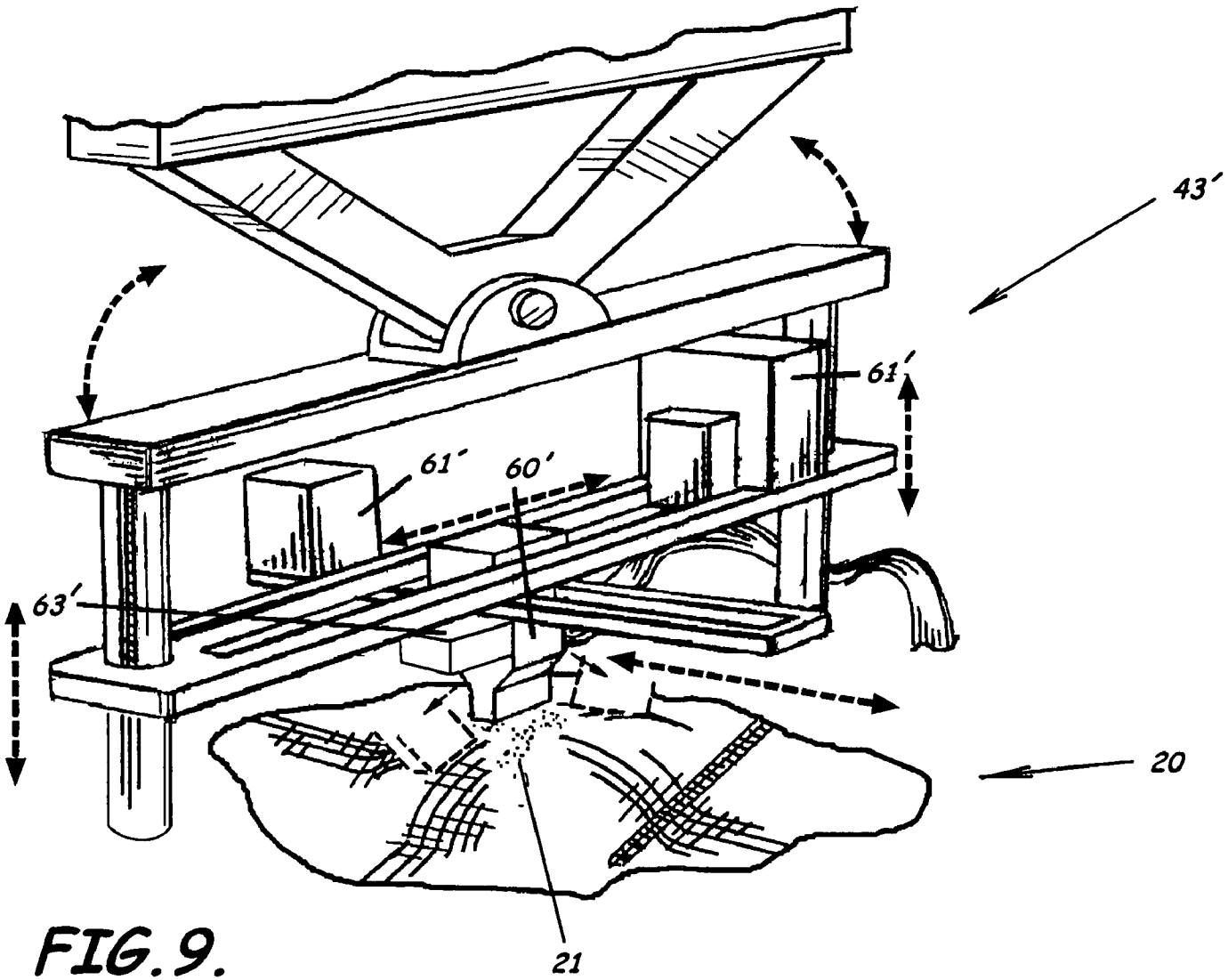
FIG. 9 is a perspective view of another portion of a system to form images on a golf bag, according to an embodiment of the present invention.

As perhaps best shown in FIGS. 8 and 9, a plurality polymerization-based curing heads such as UV curing heads 63, 63' can, but need not be, positioned axially alongside the printhead 60, 60', respectively. Additionally, instead of the illustrated UV curing heads, high-energy electron beam curing heads can instead be used. One advantage of beam-curable inks has been that they have been shown not to be limited to specific pairs of ink and fabric because the bonding is typically primarily mechanical or chemical in nature as opposed to being based on mere physical contact. Whether UV curable heads, beam curing heads, or other similar curing heads are used, the heads can be functionally part of the printhead assembly 60, 60' of the ink-jet printer. For comparative purposes, ink-jets typically provide in excess of 90,000 dots per square inch print quality. The selected dot density, however, determines the heat energy exposure required. Thus, as with heat-transfer printers, the type a fabric used becomes crucially related to the achievable image contrast and intensity.

Figure 11:
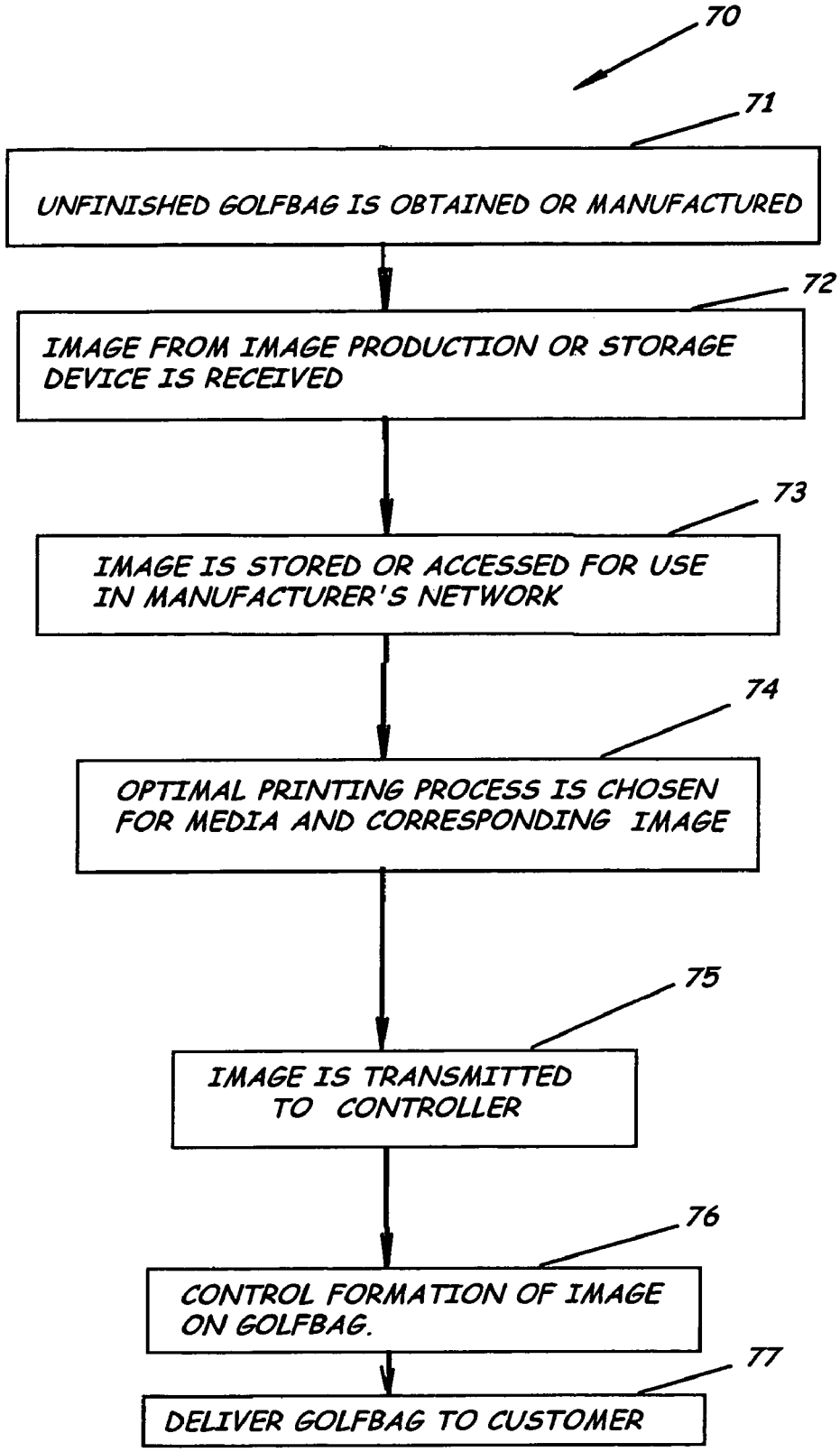
FIG. 11 is a flowchart of a method of forming images on a golf bag according to an embodiment of the present invention.

An embodiment of the present invention also advantageously includes a method 70 of forming images 21 on a golf bag 20, shown in FIG. 11 and corresponding with the partial depiction of alternative embodiments of means for forming images 21 on a golf bag 20, shown in FIGS. 6 and 10. The method 70 can include the steps of obtaining or manufacturing (providing) a golf bag 20 to have an image 21 formed, thereon (block 71); creating and obtaining an image 57 (block 72); storing or accessing the image 57 for use in the manufacturer's network (block 73); selecting an optimal printing process (block 74), if not already accomplished; transmitting the image to a controller (block 75); controlling an image forming means 43 to form the image 21 on golf bag 20 (block 76); and transporting or otherwise delivering or conveying to the customer the golf bag 20 with the image 21 formed, thereon (block 77).

The step of providing the golf bag (block 71) typically entails the manufacturer of the golf bag 20 making an offer or advertisement for its sale. The steps of creating and obtaining an image (blocks 72, 73), typically entail either the customer or photographer forming the image 57 in a digital medium or memory 58 and sending the image 57 to a database 44 accessible to the manufacturer's digital acquisition medium 53, or the customer selecting an already established image 57 from a database 44. As a methodology of maintaining prestige among a select class of golf related images or corresponding events, in order to obtain authorization from the manufacturer to implement such select image, the individual golfer must be issued a certificate 36 (FIG. 4) from a famous championship golf course signifying a particular standard of completion.

As perhaps best shown in FIG. 6, a photographer can create the image 57 with use of a digital camera 50. The photographer, intermediary, or user either transfers the image 57 directly to a manufacturer's data acquisition medium 51 or to a database 44 accessible by the manufacturer's data acquisition medium 51. This is typically accomplished via a network interface 54. For example, a photographer can either transmit the digital camera's removable storage medium 53 to the manufacturer, directly download a camera 50 to the manufacturer's network interface 54, upload the images 21 from his own computer 55 to a web site of the global network 46, or accomplish the task by any other equivalent method. Alternatively, the photographer, intermediary, or user, with use of a scanner 56, can convert an existing image, developed photographic print, or negative into a digital image 57, by scanning it into a digital medium or memory 58, using equipment well-known in the art. The existing image or developed photographic print of the target image 21 can best be scanned using a flatbed or wand-type scanner. Photographic negative strips can best be scanned using a negative scanner. Regardless of the type of scanner used, once scanned the digitized image 57 representing the target image 21 is then electronically transferred. As an alternative methodology, a point-of-sale machine (not shown), as understood by those skilled in the art, can be used to access or develop the digital image 57 stored in memory of a digital camera 50 or other imaging device (scanner, personal digital assistant, hand-held computer), and can perform a point-of-sale transaction for storing at least one of the digital images 57 at a remote site assessable to the manufacturer's data acquisition medium 51.

As perhaps best shown in FIG. 10, the golf bag manufacturer can obtain an existing photographic-type image, e.g., a picture of the golf bag owner, from a database, such as, for example, a web site of a global communications network 46. Typically the customer can select an already developed image 57 available from a database accessible to the manufacturer's data acquisition medium 51. Other alternative methodologies of obtaining an image representing an embodiment of the image 21 include non-electronic creation for subsequent transfer to the manufacturer. The end result always being creating or obtaining an embodiment of the image 21 to be formed on the outer surface 35 of the golf bag 20.

As perhaps best shown in FIG. 8, the step of controlling an image forming means 43 to form the image 21 on golf bag 20 (block 76) can include a printer controller 59 accessing the image transmitted or otherwise delivered to the manufacturer and driving stepper motors 61 to manipulate printhead 60 and optionally manipulate UV curing heads (not shown), to control the flow of the ink deposited on the receiving substrate, e.g. large pocket 32 of golf bag 20. An example of the step of controlling an image forming means 43 to form the image 21 on golf bag 20 (block 76), as perhaps best shown in FIGS. 6, and 7, also entails the actual deposition of ink on the receiving substrate, e.g., deposition of the ink on an outer surface 35 of the golf bag 20 such as the substantially flat side outer surface portion 30 of the golf bag 20, an external surface of pocket 32 or pocket 33, a laminate insert in pocket 32 or pocket 33, or on an insert into a laminate region of a golf bag 20. There are, however, significant advantages to forming the image 21 in the form of a photographic-type image and on the substantially flat side outer surface portion 30 of the golf bag 20.

The artisan has numerous methodologies available to formulate this preferably photographic-type image. The artisan must generally select a methodology to position the image 21 on the outer surface 35 of the golf bag 20, e.g., the substantially flat outer surface portion 30 or arcuate section 34. For example, the artisan may select halftone printing. If so selected, an image 57 is photographed through halftone screens, preferably with color filters to reproduce the three primary colors, cyan, yellow and magenta, plus black. This selection may be based on whether the image 21 will be mass-produced or printed in only at least one print. The selection may also and/or alternatively be based on the required quality or fineness of the screens which may be directly proportional to their cost and ease of use. The artesian may alternatively select letterpress (relief printing). If so selected, the artisan typically represents the image using metal type or engravings having raised surfaces. The ink is applied to the raised surfaces and transferred directly onto the item receiving the image (e.g. the side outer surface portion 30 of the golf bag 20).

The artisan may also select a similar means known as off-set printing (lithography), whereby the artisan uses a plate treated so that ink will adhere only to the areas that will print the design. Color printing is achieved by the artisan photographically separating from the original picture, the four basic colors (black, magenta, yellow, and cyan), making a plate for each color, and then using the plates to print the colors successively over one another. The artisan may also select another similar means including gravure printing. There is little functional difference to the artisan except that gravure printing requires the artisan recess the image areas into the plate. The artisan may also select serigraphy (silk-screen printing). If selected, the artisan prints the image by applying paint on a fabric or equivalent screen. The artisan may also select pad printing. If selected the artisan typically formulates an inked gravure, extracts the image to a transfer pad, then places the transfer pad into pressure contact with the surface of the item to receive the image. The artisan may also select thermal transfer printing. If selected, the artisan transfers a representation of the image on a target object typically using heat and contact pressure using a device such as a thermal press. Thermal transfer printing uses a thermal transfer press whereby the transfer surface is pressingly contacted upon a receiving surface. The heat and pressure is maintained for a sufficient time to allow completion of a sublimation process to occur which results in the image transfer. The artisan may also select thermal-wax-transfer printers and dye-sublimation printers, potential alternative means of heat transfer printing. The artisan may also select ink-jet (bubble-jet) printing. If selected, once a suitable type of ink-jet printer and suitable ink is selected, the artesian then either manually or automatically commands printing an image 21 by the deposition of ink droplets in a pixel-by-pixel manner to an image-recording substrate (here, the side outer surface portion 30 of golf bag 20). Drying of the ink is accomplished in accordance with the type of ink, type of fabric receiving the image, and type of print head methodology selected.

Finally, the step of transporting or otherwise delivering or conveying to the customer the golf bag 20 with the image 21 formed, thereon (block 77) typically entails shipping of golf bag 20 to the customer, but may include other methodologies including hand delivery or customer pickup.

Figure 12:
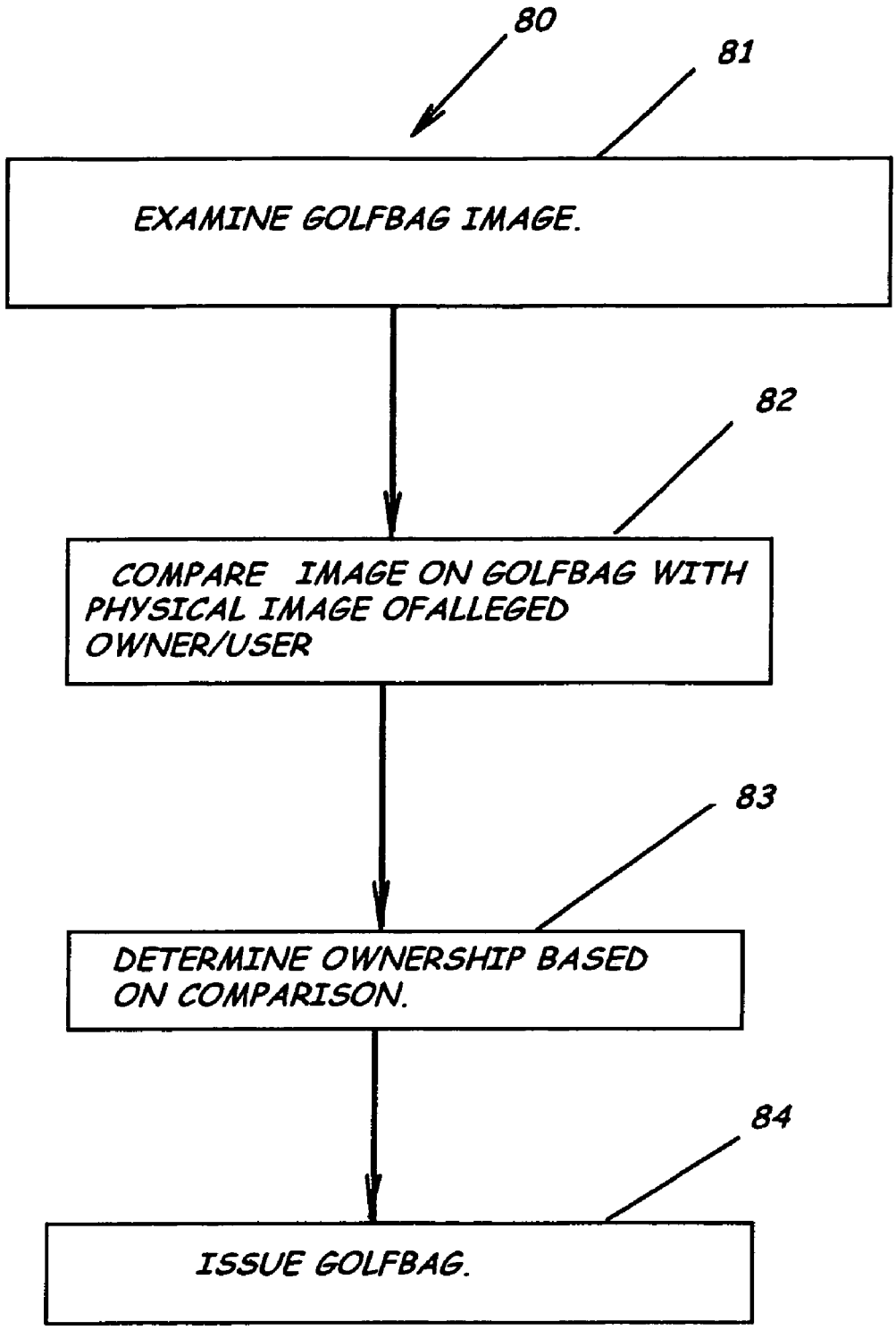
FIG. 12 is a flowchart of a method of using a golf bag having images thereon, according to an embodiment of the present invention.

Embodiments of the present invention also include methods of using a golf bag having images 21, thereon. As perhaps best shown in FIGS. 1 and 5 and as depicted in FIG. 12, illustrated is a method 80 of using a golf bag 20 having an image 21, thereon, in the form of a photographic-type image. The golf bag owner or another party examines a golf bag 20 having image 21 positioned on an outer surface 35 of the golf bag 20 (block 81). Generally, this golf bag 20 will be positioned among other golf bags, thus establishing the need for the examination. The golf bag owner or other party physically compares the image 21 with the physical appearance of the alleged golf bag owner/user (block 82). The golf bag owner or other party can expeditiously determine ownership based on the physical comparison (block 83) such that the golf bag 20 can be immediately issued (block 84) to the proper owner/user with no further identification means required.

For example, where the image 21 is a photographic-type image of the golf bag owner, a golfer drops off his golf bag 20 to be stored in the clubhouse locker room along with other similar golf bags. The golfer then returns at a later time and requests the golf bag 20, possibly from a different employee. Without the need to request a detailed description of the golf bag 20 or any identifying information from the golfer, the clubhouse employee quickly looks for the golfer's "face" on the golf bag 20, and issues the bag accordingly.

As another example, assume there is a tournament whereby a row of golf bags 20 (FIG. 5) are positioned in a golf bag stand. Also assume there are numerous spectators and much confusion. In a situation such as this, a golfer might find himself in a position where he needs his new caddie or a golf facility employee to quickly grab his golf bag 20. With no time to search for the golf bag 20 among the others, the caddie or golf facility employee, though unfamiliar with which golf bag is the golfer's, quickly recognizes (block 83) the photographic-type image 21 of his golfer and expeditiously extracts or issues the golf bag 20 from the golf bag stand (block 84). Note, the alternative embodiments listed above do not, however, rule out (block 82) as including self-recognition of the golfer or recognition by a non-employee of the golfing establishment.

In another embodiment of the present invention, a method of using a golf bag 20 having an image 21, thereon, includes a subset of the above described method steps. An image 21 in the form of a photographic-type image of a physical appearance of a golfer is formed on golf bag 20. The owner of the golf bag 20 can then present the golf bag 20 to a golfing facility employee at a golfing facility as a substitute for an identification card. Thus, advantageously, the golf bag 20 having an image 21, thereon, is not only self-identifying regarding ownership, but also can be self-authenticating, freeing the owner of the golf bag 20 from the necessity of carrying a wallet including ID card in order to not only prove ownership of the golf bag 20 but also to show authorization to use the golfing facility.

Figure 13:
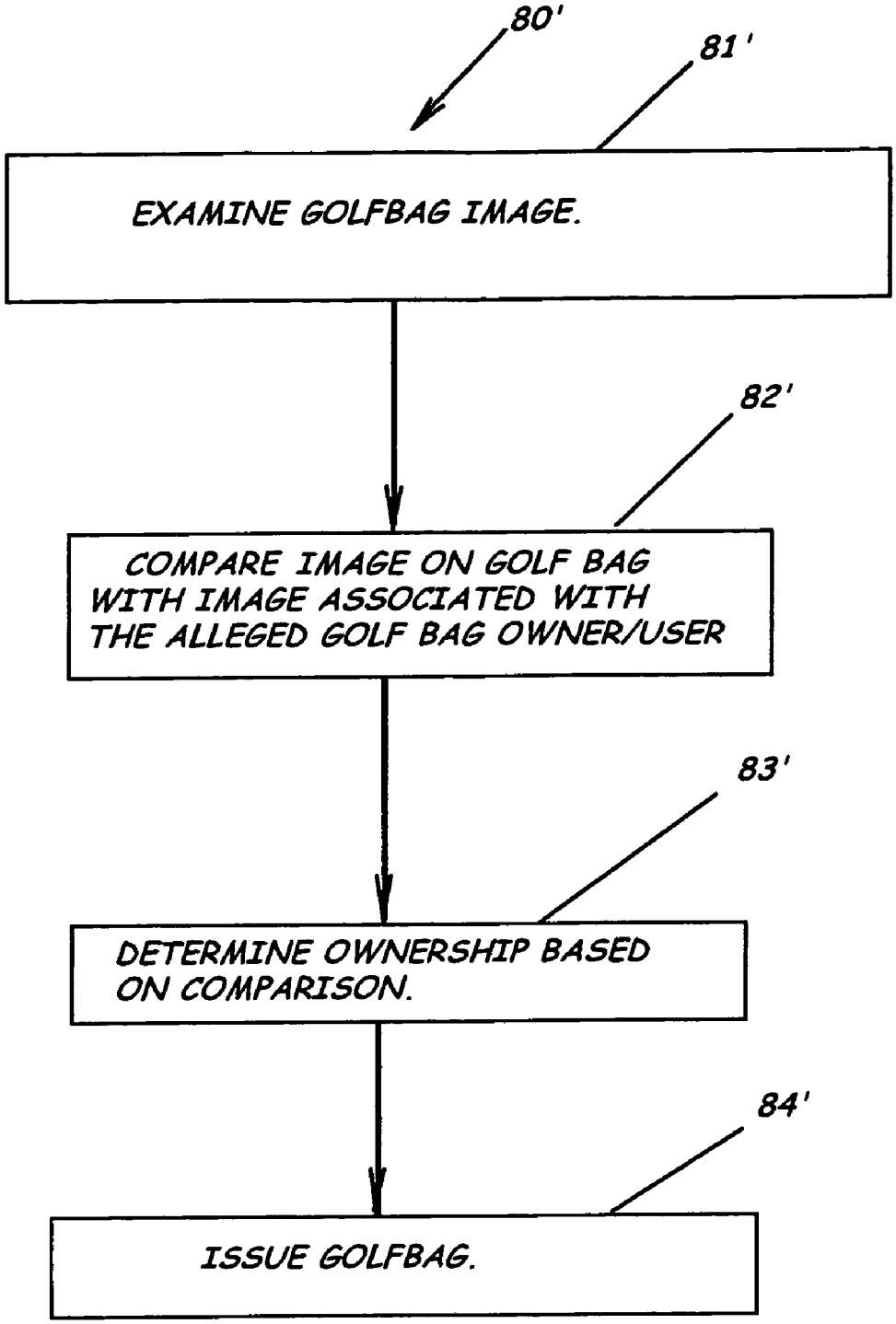
FIG. 13 is a flowchart of a method of using a golf bag having images thereon, according to an alternative embodiment of the present invention.

An alternative embodiment of the present invention includes a method 80' of using a golf bag 20 having images 21, thereon. As depicted in FIG. 13, a golf bag owner or another party examines the outer surface 35 of the golf bag 20 (block 81'). The golf bag owner or other party then physically compares the image 21, an image known by the individual retrieving the golf bag 20 to be associated with the alleged golf bag owner/user (block 82'). For example, the golf bag owner may have an image of an exceptionally famous golf course or other memorabilia associated with the golf bag owner. The golf bag owner or other party determines ownership based on the comparison of the image 21 with the image associated with the golf bag owner (block 83), i.e., the image 21 can be used as an identification card.

Again referring to the tournament example, as perhaps best shown in FIG. 5, the golf bag 20 may be positioned among a plurality of other golf bags 20 also having photographic-type images 21 and positioned in a golf bag stand. Again, in a situation such as this, a golfer might find himself in a position where he needs his new caddie or a golf facility employee to quickly grab his golf bag 20. With no time to search for the golf bag 20 among the others, the caddie or golf facility employee, though unfamiliar with which golf bag is the golfer's, quickly recognizes (block 83') the photographic-type image 21 according to a description provided by the golfer and expeditiously extracts or issues the golf bag 20 from the golf bag stand (block 84'). Note again, the embodiment described does not, however, rule out (block 82') as including self recognition of the golfer or recognition by a non-employee of the golfing establishment.

Regardless of whether the (block 83) image comparison was based upon an image 21 embodying an image of the owner of the golf bag 20 (block 82) or merely a unique image associated with the owner of the golf bag 20 (block 82'), the owner of the golf bag 20 retrieves or the other party issues the golf bag 20 to the proper owner/user based on the above described comparison.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification. For example, new and improved printing techniques can replace those described as both computer and printing advances allow improved image quality and improved ink placement and durability. Also for example, improved facial recognition devices may allow automated issuance of the golf bag having an image in the form of a facial image.

That claims is:

1. A method of forming images on an outer surface of a golf bag, the method comprising the steps of:

obtaining a photographic-type image to be formed onto a substantially flat side outer surface portion of the golf bag;

controlling image production by sending the photographic-type image to a printer and activating at least one of a plurality of printer stepper motors to form the photographic-type image onto the flat side outer surface portion of the golf bag; and printing the photographic-type image onto the substantially flat side outer surface portion of the golf bag, the photographic-type image being readily visible and substantially permanently affixed.

2. A method as defined in claim 1, wherein the photographic-type image comprises a photographic-type image of the owner of the golf bag.

3. A method as defined in claim 1, wherein the step of obtaining a photographic-type image to be formed onto the substantially flat side outer surface portion of the golf bag includes obtaining the photographic-type image from at least one of: a database, a website of a global communications network, a photography equipment storage device, and a scanner.

4. A method as defined in claim 1, wherein the step of obtaining a photographic-type image to be formed onto the substantially flat side outer surface portion of the golf bag includes a golfer obtaining a certificate from a famous championship golf course signifying a particular standard of completion.

5. A method as defined in claim 1, wherein the step of printing the photographic-type image onto the substantially flat side outer surface portion of the golf bag includes printing the photographic-type image on a fabric panel comprising a substantially permanently affixed pocket.

6. A method of forming images on an outer surface of a golf bag, the method comprising the steps of:

obtaining an image to be formed onto an exterior fabric panel of the golf bag, the exterior fabric panel being not readily removable, including a golfer obtaining a certificate from a famous championship golf course signifying a particular standard of completion;

controlling image production by sending the image to a printer to form the image onto the exterior fabric panel of the golf bag; and printing the image onto the exterior fabric panel of the golf bag, the image being readily visible and substantially permanently affixed.

7. A method of forming images on an outer surface of a golf bag, the method comprising the steps of:

obtaining an image to be formed onto an exterior fabric panel of the golf bag, the exterior fabric panel being not readily removable, wherein the image can be formed directly onto the exterior fabric of the golf bag, as a laminate insert into a pocket of the golf bag, or as an insert into a laminate region of the golf bag.

controlling image production by sending the image to a printer to form the image onto the exterior fabric panel of the golf bag; and printing the image onto the exterior fabric panel of the golf bag, the image being readily visible and substantially permanently affixed.

8. A method as defined in claim 7, wherein the step of printing the image onto the exterior fabric panel of the golf bag includes curing the ink with a polymerization process.

* * * * *